United States Patent [19]

Hašek

[11] 4,003,411

[45] Jan. 18, 1977

[54] DEVICE FOR WITHDRAWING FABRICS FROM LOOMS

[75] Inventor: Václav Hašek, Trebechovice pod Orebem, Czechoslovakia

[73] Assignee: Elitex, Zavody textilniho strojirenstvi generalni reditalstvi, Liberec, Czechoslovakia

[22] Filed: May 13, 1974

[21] Appl. No.: 469,454

[30] Foreign Application Priority Data

May 24, 1973 Czechoslovakia ..... 3742/73

[52] U.S. Cl. ..... 139/308; 66/149 R; 242/75.2

[51] Int. Cl.[2] ..... D03D 49/20

[58] Field of Search ..... 139/304, 99, 307, 308; 308/62; 66/149; 242/75.2

[56] References Cited

UNITED STATES PATENTS

| | | | |
|---|---|---|---|
| 676,376 | /1901 | Whitehurst | 139/99 |
| 2,070,147 | /1937 | Thompson | 139/304 |
| 2,107,214 | 2/1938 | Rechtin et al. | 308/62 |
| 2,776,677 | /1957 | Paquette | 139/304 |
| 3,017,061 | 1/1962 | Hobart et al. | 308/62 |
| 3,107,608 | 10/1963 | Ward | 308/62 |
| 3,209,685 | 10/1965 | Henkel | 308/62 |
| 3,645,300 | 2/1972 | Geven et al. | 139/308 |
| 3,677,305 | 7/1972 | Cutting et al. | 139/304 |
| 3,698,446 | 10/1972 | Miller et al. | 139/308 |
| 3,707,996 | 1/1973 | Zebley et al. | 139/304 |
| 3,739,817 | 6/1973 | Kunz | 139/25 |
| 3,752,378 | 8/1973 | Scheffel | 139/99 |

FOREIGN PATENTS OR APPLICATIONS

| | | | |
|---|---|---|---|
| 1,171,554 | 6/1964 | Germany | 66/149 R |
| 687,701 | 2/1940 | Germany | 242/75.2 |
| 1,399,301 | 4/1965 | France | 242/75.2 |

*Primary Examiner*—James Kee Chi

[57] ABSTRACT

Device for withdrawing fabrics from looms, particularly hydraulic jet looms. The loom has a hauling beam and at least two pressure beams, brackets carrying the pressure beams being mounted by means of eccentrics on the journals of the hauling beams. At least one of the pressure beams may be mounted on the brackets by means of further eccentrics.

2 Claims, 3 Drawing Figures

6
11
11'
2
9
7
6
11
11'
14
1
4
12
2

DEVICE FOR WITHDRAWING FABRICS FROM LOOMS

The present invention relates to a device for withdrawing fabrics from a loom, particularly a hydraulic jet loom provided with a hauling beam and with at least two pressure beams.

In hydraulic jet looms an uneven moistening of fabrics takes place due to the weaving together of different kind of material. Thus, at the picking side of the weft, differences in dissolving the finish such as the size, the dressing agent on the material to be processed are observed in proportion to the degree of moistening. Such differences result in changes in the friction of fabrics upon the hauling beam.

The devices for withdrawing the fabric from a loom, in spite of their simple arrangement and easy introduction of the fabric onto the hauling beam between one or more pressure beams, have a number of disadvantages. Such disadvantages include the fact that they do not produce the necessary pressure by a friction of the fabric on the hauling beam at the moment of pull dropping of the fabric from the wrapping device. This apparent particularly upon withdrawing the woven goods due to the pulsing tension thereof from the warp, whereupon stripiness of the fabric is caused and thus the fabric produced is of lower quality than desired.

The disadvantages of the devices hitherto known are considerably overcome by the device of the present invention. In accordance with the invention, the brackets carrying at least the pressure beams are mounted by means of eccentrics on the journals of the hauling beam.

Further advantages and features of the present invention will be apparent in the illustrative embodiment thereof shown in the accompanying drawings, in which.

Figure 1:
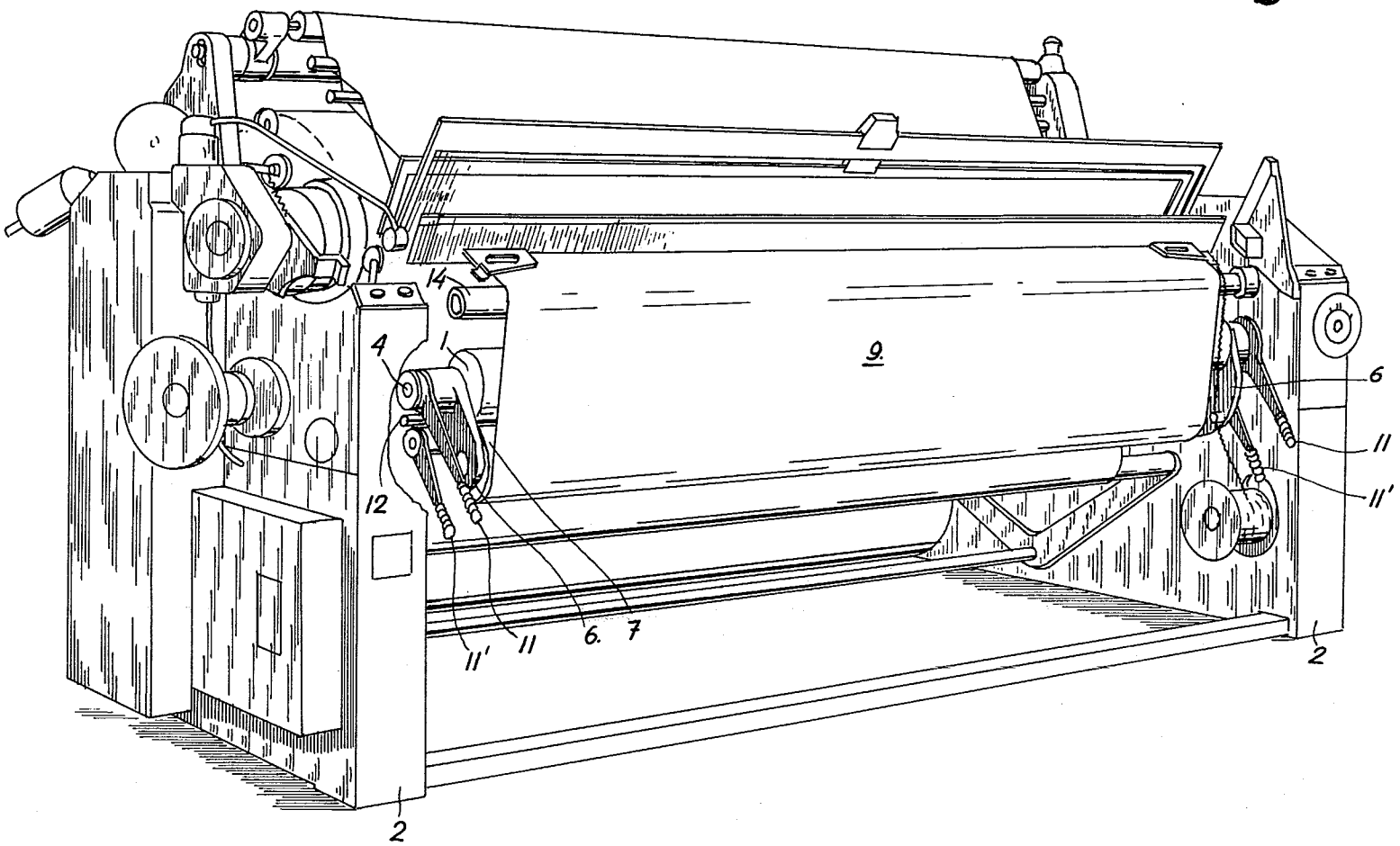
FIG. 1 is a view in perspective showing the arrangement of the device according to the present invention on a loom.
Figures 2, 3:
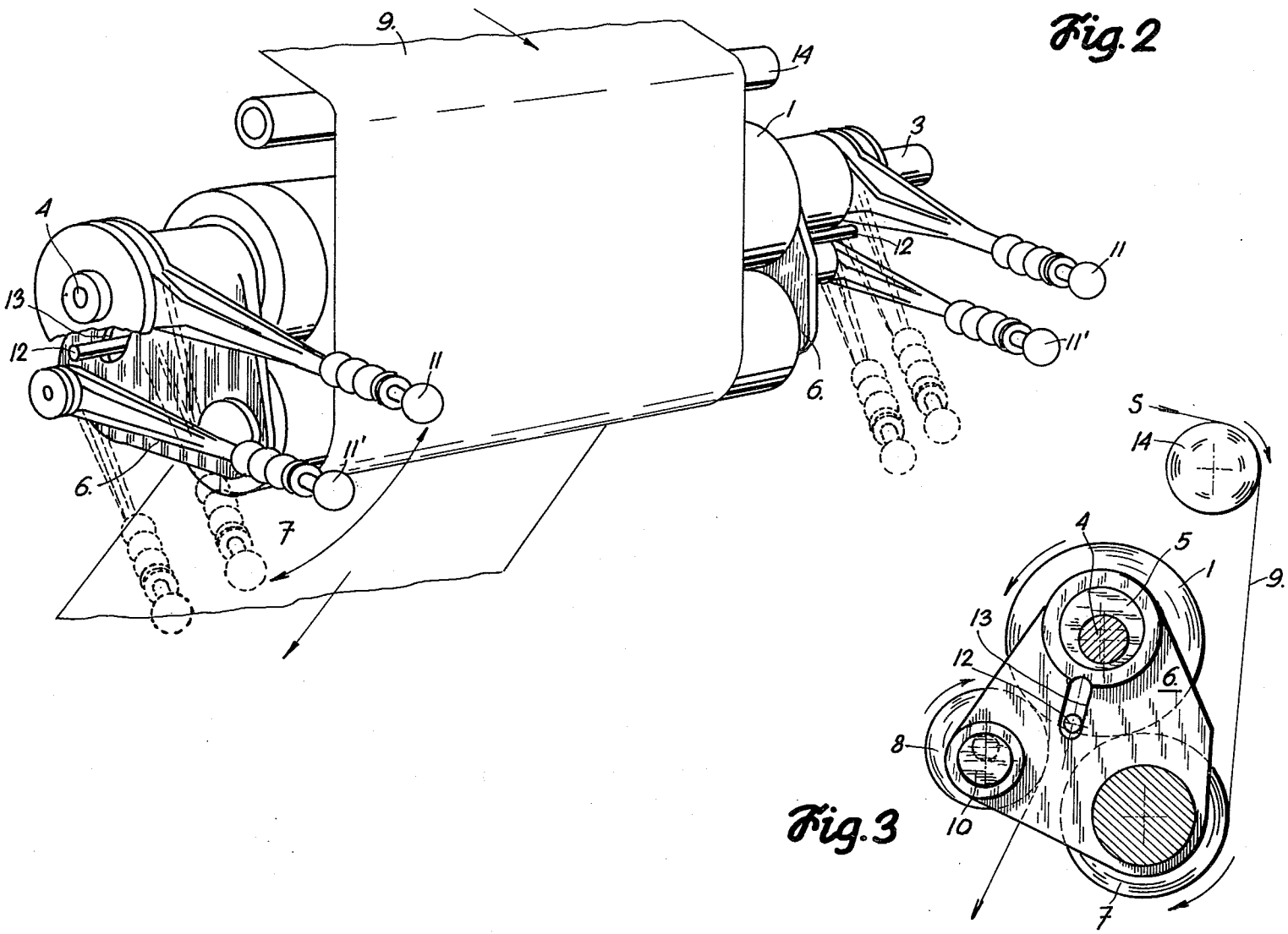
FIG. 2 is a detailed view in perspective of the device according to the present invention.
FIG. 3 is a simplified view in the end elevation of the device shown in FIG. 2, the figure showing the passage of the fabric therethrough.

The illustrative device for withdrawing the fabric according to the present invention includes a hauling beam 1, which is mounted in a known manner on the side walls 2 of a loom and is driven by the shaft 3 of the take-up motion.

On the journals 4 of the hauling beam 1 there are mounted brackets 6 by means of eccentrics 5, said brackets carrying pressure beams 7 and 8. The front beam 7, considered with respect to direction S of the fabric 9 travelling about the hauling beam 1 and the pressure beams 7 and 8, is mounted rotatably upon brackets 6, whereas the rear pressure beam 8 is also mounted rotatably, but in further eccentrics 10.

Each of the said eccentrics 5 and said further eccentrics 10 is provided with an independent lever 11, 11', respectively, for controlling its position for the purpose of causing the pressure beam 7 and 8 selectively to approach or to be withdrawn from the hauling beam 1. In order to prevent undesired turning of the brackets 6 when eccentrics 5 are turned by levers 11, said brackets 6 are guided by pins 12 which are mounted in the side walls 2 of the loom which engage grooves 13 in the brackets 6.

The device according to the present invention, as described above, operates as follows:

Fabric 9, moving in the direction S via a breast beam 14 is guided about pressure beam 7 and between said pressure beam and the withdrawing beam 1. After travelling partially along the beam 1, the fabric is stripped from the withdrawing beam by the pressure beam 8, the fabric being guided partially about the latter 2 a take - or wrapping device (not shown).

The fabric 9, may be, for example chenille cloth. In introducing such fabric into the device, the pressure beam 7 and 8 are moved from the hauling roller 1 by turning the eccentrics 5 and 10 appropriately by levers 11 and 11', respectively. Following such introduction, the beams 7 and 8 are again pressed toward the hauling beam to pinch the fabric between them and the hauling beam by the turning of the eccentrics 5 and 10 in the appropriate direction by the levers 11, 11'. Upon the rotation of the hauling beam 1, the fabric 9 is withdrawn from the loom. The pressure with which the pressure beam 7 and 8 are thrust toward the hauling beam 1 is chosen in such a manner that the friction between the fabric 9, and the hauling beam 1, and the pressure beam 7 and 8, shall be as constant as possible at all contact points.

Although the invention is illustrated and described with reference to one preferred embodiment thereof, it is to be expressly understood that it is in no way limited to the disclosure of such a preferred embodiment, but is capable of numerous modifications within the scope of the appended claims.

What is claimed is:

1. In a device for withdrawing fabric having a hauling beam journalled for rotation, first and second pressure beams cooperable with the hauling beam, and means including a first eccentric carried on the journals of the hauling beam for supporting one of the pressure beams, the improvement wherein the supporting means comprises a bracket carried by the first eccentric and exhibiting first and second spaced apertures and in which the improvement further comprises, in combination, means supporting the first one of the pressure beams within the first aperture of the bracket, a second eccentric carried in the second aperture of the bracket, and means for supporting the second one of the pressure beams on the second eccentric.

2. Device for withdrawing fabrics in accordance with claim 1, wherein the first one of said pressure beams is mounted forwardly of said hauling beam in the direction of travel of fabric through the loom, and wherein the second one of said pressure beams is mounted rearwardly of said hauling beam.

* * * * *